US007344486B2

(12) United States Patent
Casey et al.

(10) Patent No.: US 7,344,486 B2
(45) Date of Patent: Mar. 18, 2008

(54) ABDOMINAL EXERCISE MACHINE

(75) Inventors: Michael E. Casey, Santa Monica, CA (US); Wei-Teh Ho, Taipei (TW)

(73) Assignee: International Edge, Inc., Fairfield, NJ (US)

( * ) Notice: Subject to any disclaimer, the term of this patent is extended or adjusted under 35 U.S.C. 154(b) by 470 days.

(21) Appl. No.: 10/279,381

(22) Filed: Oct. 23, 2002

(65) Prior Publication Data

US 2004/0082450 A1 Apr. 29, 2004

(51) Int. Cl.
*A63B 26/00* (2006.01)

(52) U.S. Cl. ..... 482/140; 482/126; 482/142

(58) Field of Classification Search ..... 482/140–142, 482/148, 126; D21/671, 676, 673–674, 686, D21/690

See application file for complete search history.

(56) References Cited

U.S. PATENT DOCUMENTS

| | | | | | |
|---|---|---|---|---|---|
| 145,145 | A | * | 12/1873 | Baggs | 119/69.5 |
| 4,107,830 | A | * | 8/1978 | Thomson | 29/110.5 |
| 4,826,159 | A | * | 5/1989 | Hersey | 272/146 |
| 5,346,447 | A | | 9/1994 | Stearns | 482/96 |
| D370,506 | S | | 6/1996 | Clem | D21/191 |
| 5,545,114 | A | | 8/1996 | Gvoich | 482/140 |
| 5,643,182 | A | * | 7/1997 | Engel | 601/119 |
| 5,702,334 | A | | 12/1997 | Lee | 482/140 |
| 5,833,590 | A | * | 11/1998 | Chiu et al. | 482/142 |
| 5,839,998 | A | | 11/1998 | Wilkinson | 482/140 |
| 5,989,168 | A | | 11/1999 | See | 482/142 |
| 5,997,450 | A | | 12/1999 | Wilkinson | 482/142 |
| 6,017,297 | A | * | 1/2000 | Collins | 482/146 |
| 6,090,023 | A | | 7/2000 | Liu | 482/140 |
| 6,168,557 | B1 | | 1/2001 | Liao | 482/140 |
| 6,206,808 | B1 | * | 3/2001 | Ho | 482/95 |
| 6,206,809 | B1 | | 3/2001 | Habing et al. | 482/96 |
| 6,213,923 | B1 | | 4/2001 | Cameron et al. | 482/142 |
| 2004/0067831 | A1 | * | 4/2004 | Hou | 482/142 |

FOREIGN PATENT DOCUMENTS

| | | |
|---|---|---|
| WO | WO98/11952 | 3/1998 |

* cited by examiner

*Primary Examiner*—Lori Amerson
(74) *Attorney, Agent, or Firm*—Cooper & Dunham LLP

(57) ABSTRACT

An abdominal exercise device comprising a frame, a seat support fixed to said frame, a back support pivotally connected to the frame near the seat support and being disposed at a negative incline during a portion of its use, and one or more handlebars pivotally mounted to the frame and in operational contact with the rear surface of the back support for causing the back support to pivot away from the negative incline if desired by a user during the exercise. The machine may also comprise lever members fixed to the angular orientation of the handlebars and in contact with the rear surface of the back support for lifting said back support during a portion of the exercise if desired. In a preferred embodiment, the handlebars are pivotally mounted to the frame at location separate and distinct from the where the back support is connected to the frame so that the user can use the handlebars, if desired, to create a mechanical advantage in moving the back support during a portion of the exercise. Where there are two handlebars, they may also be connected to each other at one end and the user may disconnect them to provide a gated entry for the user before and after exercising.

8 Claims, 6 Drawing Sheets

ABDOMINAL EXERCISE MACHINE

BACKGROUND OF THE INVENTION

1. Field of the Invention

This invention relates to exercise machines, and in particular, exercise machines for exercising the abdominal muscles of the user.

2. Description of the Related Art

There are a number of exercise machines that workout the abdominal muscles. Virtually all, however, are simple variations on the traditional sit-ups that can be performed on a floor or other flat surface. Several provide support surfaces for the lower back, upper back, or neck, and several provide hand levers that the user can operate to assist him or her in initiating or completing a sit-up or abdominal crunch exercise.

Each of these exercise machines, however, start the user off with the user's torso in either a horizontal or slightly inclined orientation. Thus, the exercise motion in these devices is at most limited to the range of a traditional sit-up or less, but certainly not a greater range than a traditional sit-up. The current thinking by leading health instructors regarding sit-ups, however, is that after a certain angle, gravity is no longer working very much against the participant in the traditional sit-up. That is, from the floor up to an angle of about 45°, the effect of gravity on the participant's torso is causing the abdominal muscles to work hard, but beyond 45°, the effect of gravity diminishes quickly, and the resultant benefit of the sit-up also diminishes. In fact, it is not uncommon for participants to actually use the upper portion of a traditional sit-up as an opportunity to rest.

What was needed was an abdominal muscle exercise machine that goes beyond the range of a traditional sit-up. Just as the effects of gravity are greatest on a participant's abdominal muscles when the participant's back is level with a horizontal up to when the participant's back is at an angle of about 45°, the effects of gravity are also very significant when that participant's back is at an angle of about −45° as well. What is needed then is an abdominal muscle exercise machine that operates from this negative incline of about −45° or thereabout to about 45° or thereabout and require that participant to perform sit-ups throughout this range.

Different participants have different abilities in performing such a extended sit-up. The extent to which the back of a participant can be flexed in this negative inclined position and then be lifted by the participant's abdominal muscles through this range of motion varies dramatically from participant to participant. Thus, what is also needed is an exercise machine in which the participant can use other muscle groups to assist in performing this abdominal "extension and crunch" exercise, such as using a handlebar or the like.

SUMMARY OF THE INVENTION

The present invention is an abdominal exercise device comprising a frame, a seat support fixed to the frame, a back support pivotally connected to the frame near the seat support and being disposed at a negative incline during a portion of its use, and one or more handlebars pivotally mounted to the frame and in operational contact with the rear surface of the back support for causing the back support to pivot away from the negative incline if desired by a user during exercise.

The machine may also comprise lever members fixed to the angular orientation of the handlebars and in contact with the rear surface of the back support for lifting the back support during a portion of the exercise if desired. The lever members may slide or roll along the rear surface of the back support through the use of roller members, sliding members, or the like.

In a preferred embodiment, the handlebars are pivotally mounted to the frame at a location separate and distinct from the point where the back support is connected to the frame so that the user can use the handlebars, if desired, to create a mechanical advantage in moving the back support during a portion of the exercise. Where there are two handlebars, they may also be connected to each other at one end and the user may disconnect them to provide a gated entry for the user before and after exercising.

The machine may optionally have a stop lug fixed to the frame for limiting the range of motion of the back support. The stop lug can be moved to one or more different positions along the frame to vary the range of motion of the back support. The machine also may optionally have a foot restraint for providing additional leverage for said user during use of said exercise machine.

For the purposes of the present invention, the term "negative incline" is defined as an angle of the torso of a user such that the user's waist is at an elevation greater than the elevation of the user's head.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
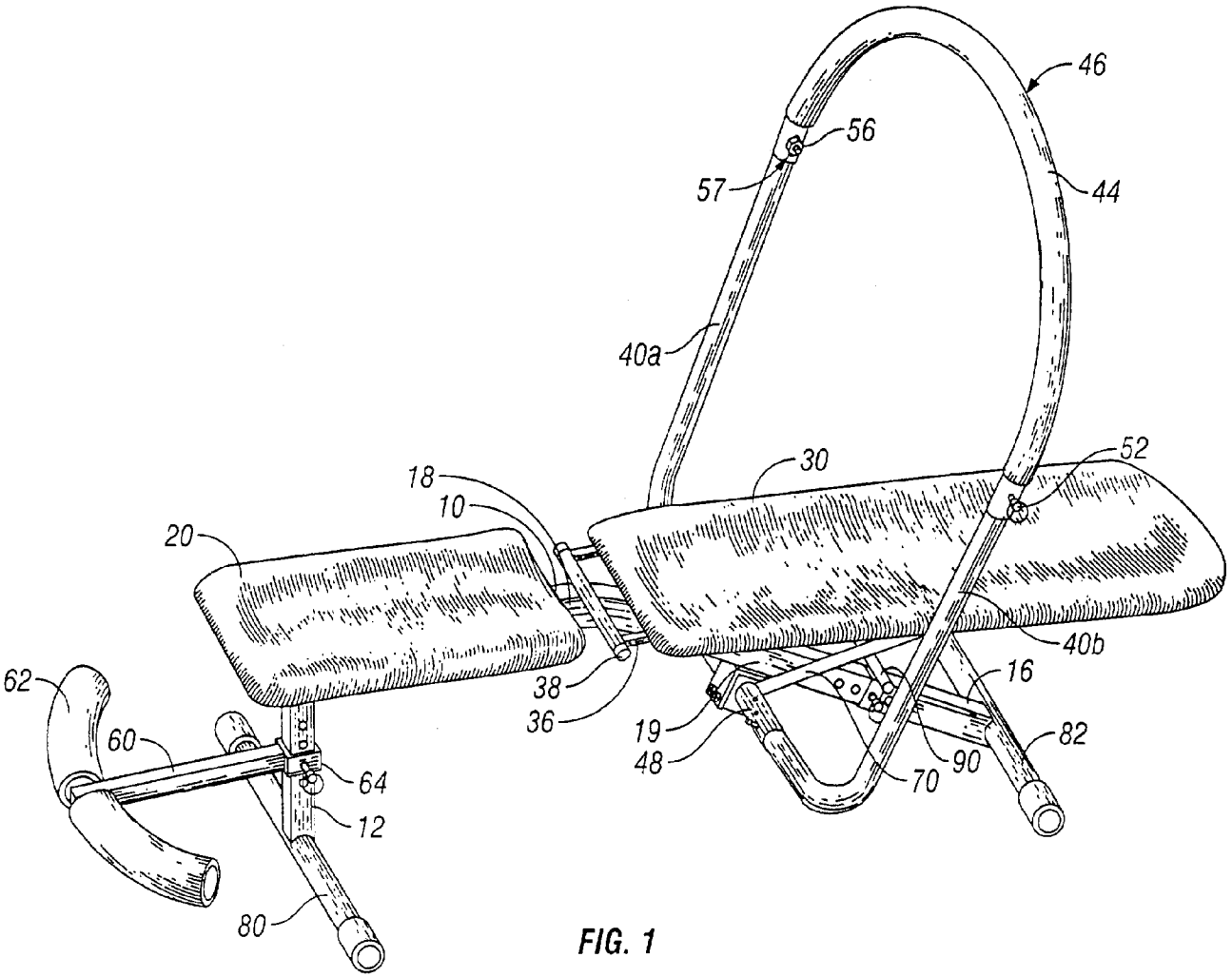
FIG. 1 is a perspective view of one embodiment of the present invention.

One preferred embodiment of the present invention is shown in FIG. 1 and comprises a frame 10, a seat support 20, a back support 30 disposed at a negative incline during a portion of its use, and one or more handlebars 40. In this embodiment, the frame 10 is a metal tubing having a generally rectangular cross section. It comprises a first leg section 12, a seat section 14, and a second leg section 16.

The first leg section 12 is substantially vertical in this embodiment, but may comprise any number of other shapes sufficient to support the weight of the user and hold the seat section 14 at the proper elevation. The first leg section 12 also comprises a number of foot restraint positions 66, either in the form of holes formed in the sides of the first leg section 12 or lugs fixed to the sides of the first leg section 12. In either instance, the foot restraint positions 66 provide a number of positions for the user to select from in fixing the foot restraint 60 to the frame 10. A first foot stand 80 is attached to one end of the first leg section 12 for supporting the exercise machine.

The seat section 14 of frame 10 is connected to the other end of the first leg section 12 and is substantially horizontal in the embodiment shown in FIG. 1. Its top surface is designed to receive the seat support 20. The present invention equally contemplates a seat section 14 that is at an angle from horizontal such that the seat support 20 is angled away from horizontal. As a result, the lower portion of the user's body would be at an angle when he or she is sitting or laying on the seat support 20.

The second leg section 16 of frame 10 is connected to the seat section 14 at bend 15 and extends down to the floor. A second foot stand 82 is fixed to the distal end of the second leg section 16 for supporting the exercise machine. The second leg section 16 comprises a number of stop lug positions 96, either in the form of holes formed in the sides of the second leg section 16 or lugs fixed to the sides of the second leg section 16. The stop lug positions 96 provide a number of positions for the user to select from in fixing the stop lug 90 to the frame 10.

The seat support 20 is fixed to the frame 10 at the top surface of seat section 14 of frame 10. While, in the embodiment shown in FIGS. 1 and 2, the seat support 20 does not move relative to the frame 10, a pivoting seat support is also contemplated in the present invention and would be consistent with the purposes of the invention. The top surface of the seat support may include a cushion material and may be covered with an elastomeric material compatible for use as a seat for a human user. The rear surface of the seat support 20 comprises a hard backing material designed to receive mounting bolts for mounting to the frame 10.

The back support 30 is pivotally connected to the frame 10 at a first pivot mount location 18, which is preferably near one end of the seat support 20, and pivot about back support pivot 38. The back support 30 is disposed at a negative incline during a portion of its use during an exercise, and has a front surface 32 and a rear surface 34. The front surface 32 may contain a cushion material and be covered by an elastomeric material that is skin-compatible. The back surface 32 comprises a stiff material to which the cushion and covering material is attached. The back surface 32 is also configured to receive back support bars 36 that are pivotally mounted to frame 10 at first pivot mount location 18 and run parallel to each other along the back surface 32 of seat support 20.

Figure 3:
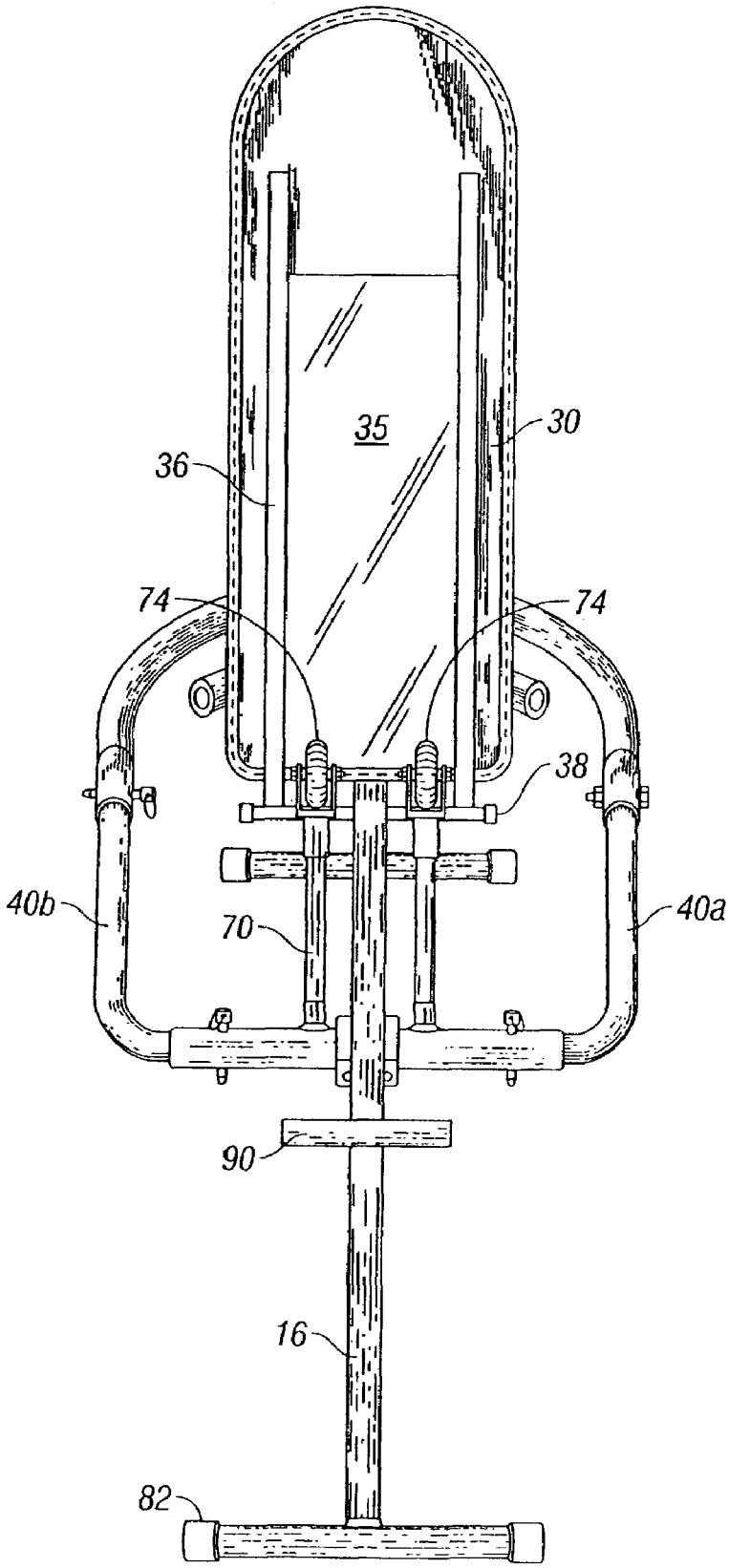
FIG. 3 is an end elevation view of the embodiment shown in FIG. 1 at a different point in an exercise, showing the rear surface 34 and contact surface 35 of back support 30.

Between the back support bars 36 is a contact surface 35, which is smooth and designed to be engaged by handlebars 40 or a portion thereof for forcing the back support 30 to pivot when handlebars 40 are manipulated. The embodiment illustrated in FIG. 3 utilizes a sturdy cardboard material for the contact surface 35, but a number of other materials would work just as successful at providing a surface along which a portion of handlebars 40 roll or slide when handlebars 40 are rotated.

The handlebars 40 pivot about handlebar pivot 48 and are pivotally mounted to frame 10 at a second pivot mount location 19. As discussed above, handlebars 40 are also in operational contact with the back support 30 and capable of causing back support 30 to pivot away from the negative incline if desired by a user to assist the user during at least a portion of the exercise. In the embodiment illustrated in FIGS. 1 and 2, the handlebars 40 are additionally equipped with lever members that are fixed to the angular orientation of the handlebars 40 and in contact with the rear surface 34 of the back support 30 for lifting the back support during a portion of the exercise if desired. The lever members 70 may slide or roll along the rear surface 34 of the back support 30 by the addition of roller members 74 or other suitable sliding members at the distal end 72 of lever members 70. An example of such roller members 74 is illustrated in the embodiment shown in FIG. 2. Sliding members could be used instead, and could comprise a slick surface at the distal ends 72 of the lever members 70 or pins that ride along grooves formed in the contact surface 35 of the back support 30.

In a preferred embodiment, the second pivot mount location 19, the point where handlebars 40 are pivotally mounted to the frame 10, is located at a point on frame 10 that is separate and distinct from the first pivot mount location 18, which is the point where the back support 30 is connected to the frame 10. The result of this configuration is that the user can use the handlebars 40, if desired, to create a mechanical advantage in moving the back support 30 during a portion of the exercise. That is, unlike other existing devices that comprise handles mounted directly on the back support member, the present invention offers the user a mechanical advantage by mounting handlebars 40 at a separate and distinct fulcrum than the fulcrum of back support 30 to provide a mechanical advantage when operating the handlebars 40. As a result, the user can employ other muscles to assist his or her abdominal muscles during a portion of the exercise in the event the abdominal muscles are weak, tired, or for example, overextended due to the negative incline of the back support 30.

Figure 2:
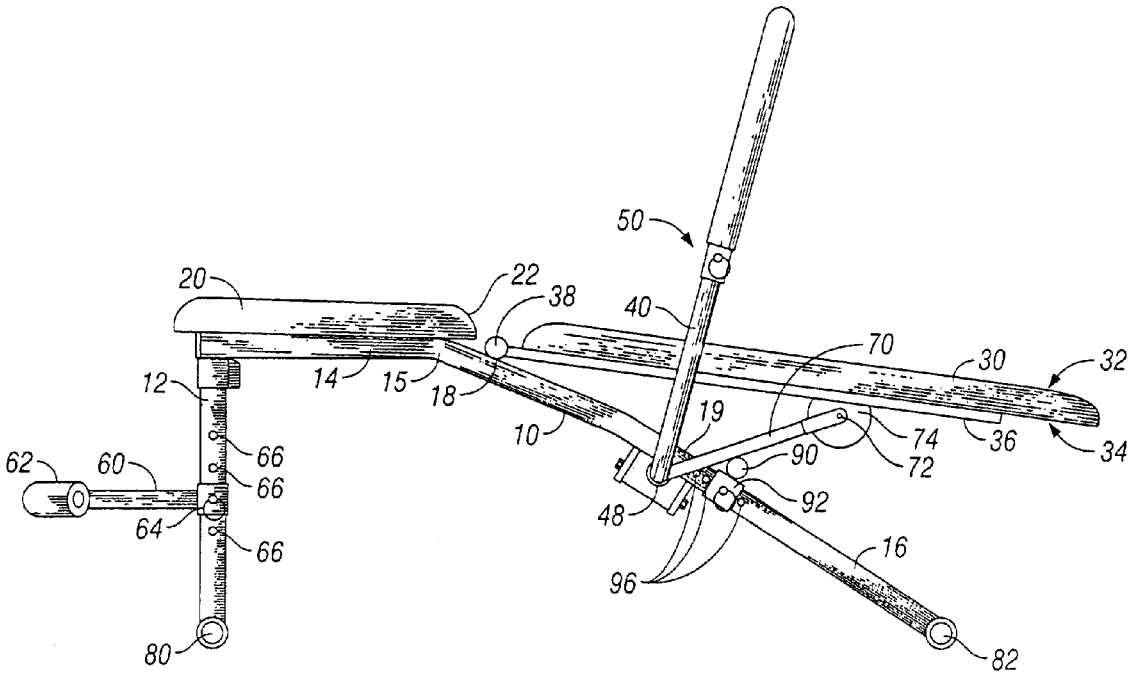
FIG. 2 is a side elevation view of the embodiment shown in FIG. 1.

The embodiment in FIGS. 1 and 2 show two handlebars 40 that are connect to each other at one end through an arched portion 44 having a gripping surface 46. This arched handlebar configuration provides the user with a multitude of hand-gripping orientations. Each different hand-gripping orientation can cause the user to exercise a different set of muscles. When the user grips the handlebars 40 near the middle of the arch such that his or her hands are touching or close to each other, the user can exercise his or her triceps during the workout as well as his or her abdominal muscles. When the user grips the handlebars 40 nearer the sides of the arch, the user can exercise his or her biceps and pectoralis muscle groups during the workout as well as his or her abdominal muscles.

Figure 4B:
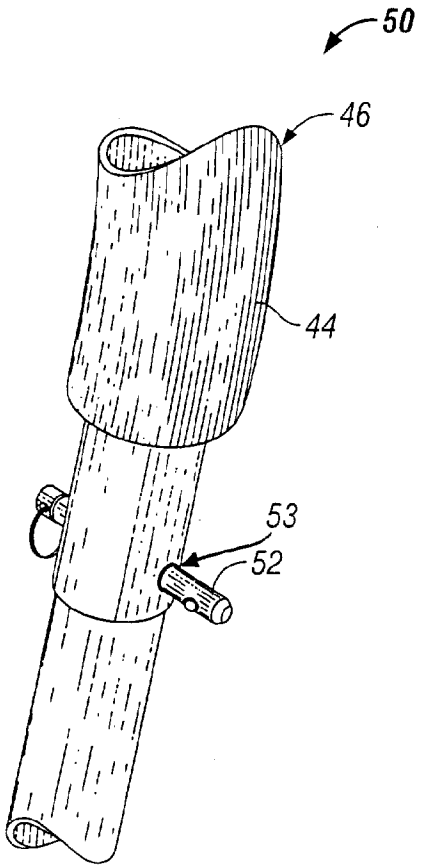
FIGS. 4*a* and 4*b* are perspective views of another embodiment of the present invention showing a detachment and hinge mechanism for detaching the handlebars.
Figure 4A:
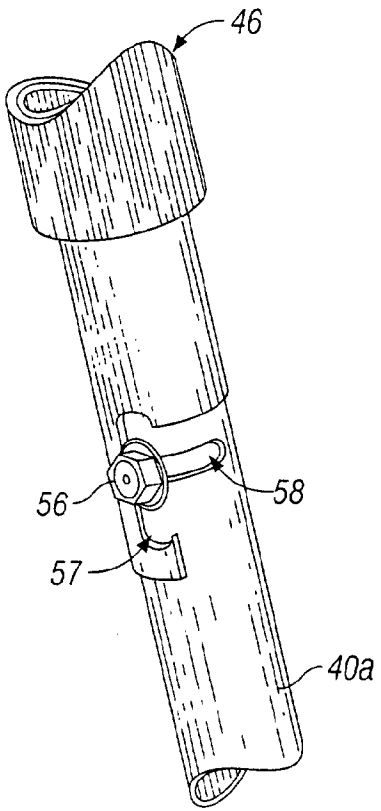

In this arched handlebar embodiment, the handlebars 40 are also equipped with a detachment mechanism 50 so that the user may disconnect them for a "gated entry" before and after exercising. This detachment mechanism 50 is illustrated in FIGS. 4*a* and 4*b*. As can be seen in FIG. 4*a*, the arch portion of the handlebars 40 is made of tubing with a larger diameter than the rest of handlebars 40. The arched portion 44 could just as easily be of a smaller diameter, however.

Figure 5:
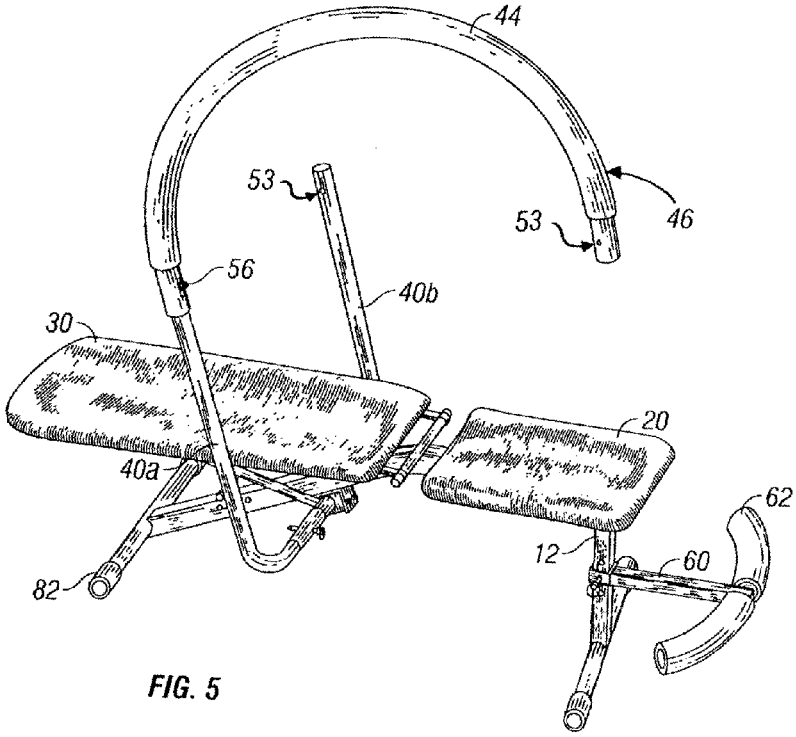
FIG. 5 is a perspective view of the embodiment of FIGS. 4*a* and 4*b* where the handlebars 40*a* and 40*b* are disconnected.
Figure 6:
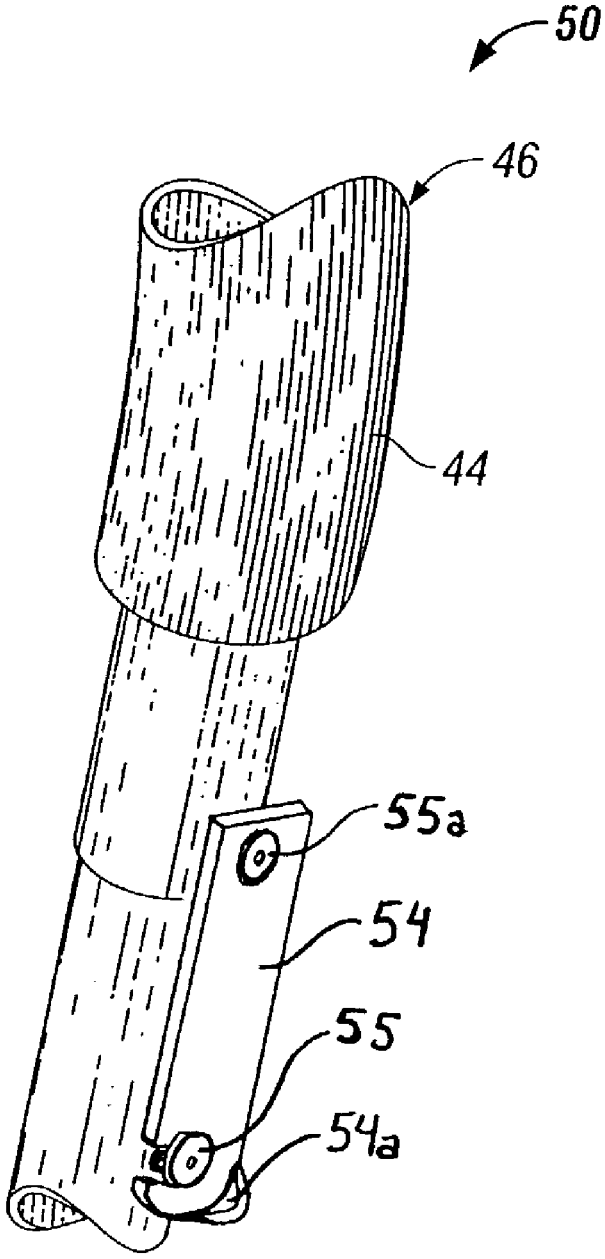
FIG. 6 is a perspective view of another embodiment of the present invention in which the arched portion 44 of the handlebars 40 is releasable by clasp 54.

In either instance, the arched portion 44 may be rotated about the longitudinal axis of handlebar 40*a*, but for the fact that it is attached to handlebar 40*b*. Therefore, at one end of the arch, there is a clasp 54 or other suitable fastening device, such as linchpin 52, connecting the arched portion 44 to handlebar 40*b*. Where the fastening device is linchpin 52, as in FIG. 1, the linchpin 52 may be removed from linchpin holes 53 freeing the arched portion 44 from handlebar 40*b*. Where clasp 54 is used, as shown in FIG. 6, it may be released from handlebar post 55 and rotated about anchor post 55*a* thereby freeing the arched portion 44 from handlebar 40*b*. The other end of the arched portion, then, is connected to handlebar 40*a* with a hinge bolt 56 that extends through slots 57 and 58. Axial hinge slots 57 are elongated along the axial direction of handlebar 40*a*, and circumferential hinge slots 58 are elongated about a portion of the circumference of handlebar 40*a*. Thus, once clasp 54 if released and rotated away from handlebar post 55 (or the linchpin 52 is removed from linchpin holes 53), the arched portion 44 may be first lifted in the direction of the axis of handlebar 40*a*, and once hinge bolt 56 reaches circumferential slots 58, the arched portion 44 may then be rotated about the axis of handlebar 40*a* as shown in FIG. 5 so that the user can easily move between the handlebars 40 regardless of the user's height.

The embodiment of FIG. 2 also has a stop lug 90 fixed to the frame 10 for limiting the range of motion of the back support 30. The stop lug 90 can be moved to one or more different positions 96 along the frame 10 by adjusting locking collar 92. Changing the position of stop lug 90 changes the range of motion of the back support 30. The machine also may optionally have a foot restraint 60 for providing additional leverage for said user during the workout. The foot restraint 60 can be moved to one or more different positions 66 along the frame 10 to vary its position for users of different sizes.

Also, as shown in FIGS. 1 and 2, a foot restraint 60 may be fixed to the first leg section 12 of frame 10 using a locking collar 64. The foot restraint 60 may be moved to different foot restraint positions 66 to accommodate users of different sizes.

In order to operate the embodiment of the present invention illustrated in FIG. 1, a user removes linchpin 52 (or releases clasp 54 or the like as in FIG. 6 by applying pressure to thumb portion 54*a*) from the arched portion 44 of handlebars 40, lift the arched portion 44 up and then rotate the arched portion 44 to provide a gated entry to the machine. The user sits down on seat support 20 and then lay the rest of the way down on back support 30 such that the user's back is supported by back support 30. The user then may adjust foot restraint 60 by moving the foot restraint locking collar 64 up or down to fit the user's leg length.

The user then closes the arched portion 44 of the handlebar 40 and replaces the linchpin 52, or fastens clasp 54 or other similar device. The user grasps the gripping surface 46 of the handlebars 40 and places his or her feet behind the cushioned surfaces 62 of foot restraint 60. The user then can begin the workout.

The user can initiate the workout either by directly lifting his or her torso contracting the abdominal muscles (using the foot restraints as a point of leverage) or by assisting this motion by pulling downwardly on the handlebars 40. In either instance, the user's torso moves through the range of motion as defined by the positioning of stop lug 90 and the end of pivoting movement of back support 30.

In FIG. 1, the user's head is somewhat lower than his or her waist during a portion of the workout, causing the abdominal muscles to be hyperextended and requiring the user to work his or her abdominal muscles throughout a greater range of motion. Moreover, as discussed above, the particular range that is prescribed by the present invention increases the extent that gravity affects the workout. That is, by requiring the user to workout of a negative incline, the present invention increases the amount of the workout that experiences the most pulling effect from gravity.

As discussed above, gravity does not substantially work against an sit-up where the torso of the participant is already upright or nearly already upright. In order to increase the effectiveness of a sit-up, therefore, the inventor found that it would be beneficial to invent a machine that requires the user to perform sit-ups starting out at a negative incline (that is, where the head of the participant is below the elevation of his or her waist), or at least experience a negative incline at some portion of the sit-up. In constructing such an abdominal hyperextension and crunch exercising machine, however, the inventor found it additionally beneficial to include handlebars 40 that provide a separate fulcrum location 19 and lever arm to assist the user if necessary or desired during at least a portion of the sit-up exercise.

By moving the stop lug 90, the user can greatly vary the amount of work that is required in performing a sit-up in the exercise machine. If the user wants to experience a more strenuous exercise by having a greater negative incline, he or she can simply move the locking collar 92 of stop lug 90 down to a lower stop lug position 96 along the second leg section 16 of the frame 10. If the user prefers a less strenuous exercise through a negative incline, he or she would move the locking collar 92 of stop lug 90 up to a higher stop lug position 96 along the second leg section 16 of the frame 10.

While the present invention has been described with regards to particular embodiments, it is recognized that additional variations of the present invention may be devised without departing from the inventive concept.

What is claimed is:

1. An abdominal exercise device comprising:

a frame, a seat support fixed to said frame, a back support pivotally connected to said frame at a point on said frame near one end of said seat support, said back support having a front surface and a rear surface and being disposed at a negative incline relative to a pivot point which is an angle torso of a user such that the user's waist is at an elevation greater than the elevation of the user's head during at least a portion of its use, and one or more handlebars pivotally mounted to said frame and in operational contact with said back support to move said back support and cause said back support to pivot away from said negative incline if desired by a user of said exercise device during use of said exercise device, wherein said handlebars further comprise one or more lever members fixed to the angular orientation of said one or more handlebars, wherein said one or more lever members are in communication with said back support for lifting said back support during use if desired, and wherein each of said one or more lever members further comprise a sliding member on its distal end for sliding along said rear surface of said back support during use.

2. A method for performing an abdominal exercise comprising the steps of:

sitting on a seat portion of a frame of an exercise machine, laying at least one's back on a back support that is pivotally connected to said frame, and is disposed at a negative incline which is an angle of the torso of a user such that the user's waist is at an elevation greater than the elevation of the user's head during a portion of its use, using one or more handlebars pivotally mounted to said frame at a location distinct from said pivot connection of said back support in order to obtain a mechanical advantage, in causing said back support to pivot away from said negative incline which is an angle of the torso of a user such that the user's waist is at an elevation greater than the elevation of the user's during at least a portion of an exercise, and limiting the range of motion of said, back support by fixing a stop lug to said frame.

3. A method for performing an abdominal exercise comprising the steps of:

sitting on a seat portion of a frame of an exercise machine, laying at least one's back on a back support that is pivotally connected to said frame, and is disposed at a negative incline which is an angle of the torso of a user such that the user's waist is at an elevation greater than the elevation of the user's head during a portion of its use, and using one or more handlebars pivotally mounted to said frame at a location distinct from said pivot connection of said back support in order to obtain a mechanical advantage in causing said back support to pivot away from said negative incline which is an angle of the torso of a user such that the user's waist is at an elevation greater than the elevation of the user's head during at least a portion of an exercise, wherein said step of using one or more handlebars to obtain a mechanical advantage comprises the step of moving one or more lever members fixed to the angular orientation of said one or more handlebars to press against a rear surface of said back support.

4. A method for exercising as in claim 3 further comprising the steps of disconnecting said one or more handlebars before said exercise in order to have a gated entry to said back support, and then reconnecting said one or more handlebars before commencing said exercise.

5. A method for exercising as in claim 3 further comprising the steps of altering the range of motion of said back support by moving a stop lug fixed to said frame.

6. A method for exercising as in claim 3 further comprising the steps of using a foot restraint to provide additional leverage during at least a portion of said exercise.

7. A method for exercising as in claim 3 wherein said step of using one or more handlebars to obtain a mechanical advantage further comprises the step of rolling roller members located between said lever members and said rear surface for lifting said back support during at least a portion of said exercise.

8. A method for exercising as in claim 3 wherein said step of using one or more handlebars to obtain a mechanical advantage further comprises the step of sliding sliding members located between said lever members and said rear surface for lifting said back support during at least a portion of said exercise.

* * * * *